US009033733B2

(12) United States Patent
Takahashi et al.

(10) Patent No.: US 9,033,733 B2
(45) Date of Patent: May 19, 2015

(54) PRESSING TERMINAL AND TERMINAL PRESSING DEVICE

(71) Applicant: Hirose Electric Co., Ltd., Tokyo (JP)

(72) Inventors: Maori Takahashi, Tokyo (JP); Masao Okada, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 13/956,566

(22) Filed: Aug. 1, 2013

(65) Prior Publication Data

US 2013/0316578 A1 Nov. 28, 2013

Related U.S. Application Data

(62) Division of application No. 12/816,700, filed on Jun. 16, 2010, now Pat. No. 8,826,523.

(30) Foreign Application Priority Data

Jun. 17, 2009 (JP) ..... 2009-144548

(51) Int. Cl.
*H01R 9/05* (2006.01)
*H01R 4/18* (2006.01)
*H01R 43/048* (2006.01)

(52) U.S. Cl.
CPC ..... *H01R 9/0518* (2013.01); *H01R 4/185* (2013.01); *H01R 43/048* (2013.01)

(58) Field of Classification Search
USPC ..... 439/585, 775, 877, 879
See application file for complete search history.

(56) References Cited

U.S. PATENT DOCUMENTS 5,055,062 A 10/1991 Sato
6,384,335 B1 * 5/2002 Saito et al. ..... 439/585

FOREIGN PATENT DOCUMENTS

JP 03-159076 A 7/1991
JP 07-335363 A 12/1995
JP 10-312858 A 11/1998
JP 2008-153056 A 7/2008
JP 2010-015701 A 1/2010

OTHER PUBLICATIONS

Office Action for Japanese Patent Application 2009-144548, Japan Patent Office, Aug. 30, 2011.

* cited by examiner

*Primary Examiner* — Tho D Ta
(74) *Attorney, Agent, or Firm* — Kubotera & Associates, LLC

(57) ABSTRACT

A pressing terminal includes an outer conductive member having a shield outer tube; an inner conductive member; and a dielectric member. The dielectric member includes a protruding portion fitted into the shield outer tube so that a signal line pressing portion of the inner conductive member is situated at a pressing tool insertion opening portion. The dielectric member is inserted into a shield outer tube with the protruding portion thereof sliding against the shield outer tube. A terminal pressing device includes an anvil unit and a crimper unit. Upon attaching the signal wire, a claw portion of a signal line crimper of the crimper unit is inserted into a claw insertion groove portion of a signal line anvil of the anvil unit. A terminal pressing anvil portion of the signal line anvil is ushered to a terminal pressing anvil insertion portion of the signal line crimper.

3 Claims, 17 Drawing Sheets

PRESSING TERMINAL AND TERMINAL PRESSING DEVICE

CROSS-REFERENCE TO RELATED APPLICATIONS

This is a divisional application of a prior application Ser. No. 12/816,700, filed Jun. 16, 2010, pending.

BACKGROUND OF THE INVENTION AND RELATED ART STATEMENT

The present invention relates to a pressing terminal provided in an electrical connector which is used for an electronic control device and the like, and a terminal pressing device for pressing the pressing terminal to a shield wire.

As shown in FIG. 19, in a conventional electrical connector, a connector socket 100 includes a socket connecting portion 103 in which a socket contacting terminal or a mating terminal 101 is attached to a socket insulating housing 102. The mating pressing terminal 101 includes a mating outer conductive member 105 and a mating inner conductive member 106. The mating outer conductive member 105 includes a shield outer tube 107. The shield outer tube 107 includes a shield contact terminal 108, a piece having a tongue-like shape formed by cutting and raising a central portion of both side surfaces thereof.

In addition, as shown in FIG. 19, in the conventional electrical connector, a connector plug 110 includes a plug insulating housing 111 and a plug contacting terminal or a pressing terminal 112 inserted into the plug insulating housing 111. As shown in FIG. 20, the pressing terminal 112 includes an outer conductive member 114; a dielectric member 116; and an inner conductive member 113. The outer conductive member 114 includes a shield outer tube 117; a pressing tool insertion opening portion 115; and an outer conductive member pressing portion 118.

Further, the inner conductive member 113 is attached to the dielectric member 116 by forcibly inserting the inner conductive member 113 into a central conductive member pressing hole 116*b* (refer to FIG. 21) of the dielectric member 116. Furthermore, the dielectric member 116 is inserted into the shield outer tube 117. Thereby, the pressing terminal 112 is configured.

In the conventional electrical connector described above, as shown in FIG. 21, the dielectric member 116 is inserted into the shield outer tube 117 as an outer circumference surface 116*a* of the dielectric member 116 slides against an inner circumference surface 117*a* of the shield outer tube 117. A pressing piece 120 as a terminal barrel of a signal line pressing portion 119 of the inner conductive member 113 can be situated shifting from a center of the pressing tool insertion opening portion 115 due to a clearance between the outer circumference surface 116*a* of the dielectric member 116 and the inner circumference surface 117*a* of the shield outer tube 117.

In addition, a conventional terminal pressing device includes an anvil unit as a pressure receiving unit and a crimper unit as a pressure applying unit. The anvil unit receives the pressing terminal 112 in a specific pressing position, and the crimper unit presses and attaches the pressing terminal 112 to an end portion of the shield wire together with the anvil unit. As shown in FIG. 22, the anvil unit includes a signal line anvil 121, and the crimper unit may include a signal line crimper 122 for swaging the pressing piece 120 of the signal line pressing portion 119 together with the signal line anvil 121.

The signal line anvil 121 includes a terminal pressing anvil portion 123, and the signal line crimper 122 includes a pair of claw portions 124 and a terminal pressing anvil insertion portion 125 between the pair of the claw portions 124, respectively. The terminal pressing anvil insertion portion 125 allows the terminal pressing anvil portion 123 to enter therein. A signal line (not shown) of the shield wire (not shown) is pressed and fixed by swaging the pressing piece 120 of the signal line pressing portion 119 with the terminal pressing anvil portion 123 and the claw portion 124.

In addition, one of conventional terminal pressing devices is disclosed in Japanese Patent Publication. The conventional terminal pressing device presses and attaches a pressing terminal situated in a connector housing of an electrical connector to an end portion (a portion including an end portion of a signal line and an end portion of an external covering) of a shield wire to which a peeling process was performed.

Patent Reference: Japanese Patent Publication No. 07-335363

In Patent Reference, the connector housing of an electrical connector is a resin molding made integrally, including a bottom plate portion; a pair of side plate portions facing each other formed continuously from the bottom plate portion; and a plurality of partition plates disposed between the side plate portions with specific intervals. A terminal placing room is provided between the side plate portion and the partition plate, and between the partition plates.

Further, an anvil insertion opening portion is provided in a predetermined position of the bottom plate portion. The anvil insertion opening portion allows an anvil to insert therein, as a pressing unit. Furthermore, the pressing terminal includes a wire barrel (a pressing piece) for being pressed to attach against the end portion of the signal line of the shield wire, and an insulation barrel (a pressing piece) for being pressed to attach against an end portion of the external covering of the shield wire.

The pressing unit includes a pressure receiving portion and a pressure applying portion. The pressure receiving portion receives the pressing terminal, which is placed in the connector housing, in a specific position thereof. The pressure applying portion applies a pressure for pressing and attaching the pressing terminal to the end portion of the shield wire together with the pressure receiving portion. The pressure receiving unit includes a signal line anvil for receiving the wire barrel, and the pressure applying unit includes a signal line crimper for pressing and attaching the pressing terminal to the end portion of the shield wire in with the signal line anvil, respectively.

Moreover, the signal line crimper faces the pressing terminal in the terminal insertion room corresponding to a pressing position from an opening portion of a terminal insertion room. The signal line anvil faces the pressing terminal in the terminal insertion room corresponding to a pressing position via the anvil insertion opening portion. The signal line anvil and the signal line crimper swage the wire barrel of the pressing terminal by sandwiching the wire barrel, thereby attaching the pressing terminal to the shield wire.

As shown in FIG. 21, when the conventional pressing terminal 112 is assembled, the pressing piece 120 of the signal line pressing portion 119 of the inner conductive member 113 can be situated shifting from the center of the pressing tool insertion opening portion 115 due to the clearance between the outer circumference surface 116*a* of the dielectric member 116 and the inner circumference surface 117*a* of the shield outer tube 117.

Therefore, it is not easy to obtain a space for a wiring process precisely. When pressing tools (the signal line anvil 121 and the signal line crimper 122) are designed so that pressing teeth (the terminal pressing anvil portion 123 and the pair of the claw portions 124) of the pressing tool and the pressing piece 120 of the signal line pressing portion 119 do not interfere with each other, it is difficult to downsize the pressing terminal 112, resulting in enlarging dimensions of the electrical connector as a whole. Therefore, it is difficult to downsize the electrical connector as a whole. Especially, when the shield wire is attached by swaging the pressing piece 120 of the signal line pressing portion 119 of the inner conductive member 113 situated in the pressing tool insertion opening portion 115, the problem described above occurs noticeably due to a remarkably limited range which is capable of clamping the shield wire.

In addition, in the conventional terminal pressing tool or the conventional terminal pressing device shown in FIG. 22, when the signal line is attached, a force is applied to the pair of the claw portion 124 of the signal line crimper 122 so as to open in a direction shown with arrows in FIG. 23, since the signal line is pressed and attached by swaging the pressing piece 120 of the signal line pressing portion 119 with the pair of the claw portion 124 of the of the signal line crimper 122.

As a result, a tip portion of the signal line crimper 122 has a crack W. Consequently, it is not possible to make the tip portion of the signal line crimper 122 finer. Accordingly, it is not possible to downsize the pressing terminal 112, resulting in enlarging dimensions of the electrical connector as a whole. Therefore, it is difficult to downsize the electrical connector as a whole.

Further, as the signal line is attached at the signal line pressing portion 119 in the pressing tool insertion opening portion 115, the claw portion 124 is not allowed to have a thick wall portion due to both of the sidewall portions 115*a* of the pressing tool insertion opening portion 115. When a tip portion of the claw portion 124 is fine, the tip portion of the signal line crimper 122 has the crack W.

Consequently, it is difficult to make the tip portion of the signal line crimper 122 finer. As a result, it is difficult to downsize the pressing terminal 112, resulting in enlarging dimensions of the electrical connector as a whole. Therefore, it is difficult to downsize the electrical connector as a whole.

Furthermore, the signal line crimper 122 has a plate-like shape. Therefore, the tip portion of the signal line crimper 122 has the crack W since the signal line crimper 122 does not have sufficient strength. Therefore, it is difficult to make the tip portion of the signal line crimper 122 finer. As a result, it is difficult to downsize the pressing terminal 112, resulting in enlarging dimensions of the electrical connector as a whole. Therefore, it is difficult to downsize the electrical connector as a whole.

In addition, in the conventional terminal pressing device in Patent Reference, the signal wire crimper is inserted into the terminal insertion room from the opening portion of the terminal insertion room, and the signal line anvil is inserted into the terminal insertion room from the anvil insertion opening portion, respectively, and further, the wire barrel of the pressing terminal in the terminal insertion room is sandwiched with the signal wire crimper and the signal line anvil.

Further, the pressing terminal is pressed and attached to the shield wire by swaging the wire barrel. In the pressing terminal in which the outer conductive member holds the inner conductive member in the shield outer tube via the dielectric member, it is not arranged such that the signal line crimper presses and attaches the signal line of the shield wire by swaging the pressing piece of the signal line pressing portion together with the signal line anvil in the pressing tool insertion opening portion.

In order to solve the above-described problems, a first object of the present invention is to provide a pressing terminal capable of downsizing, and eventually capable of downsizing an electrical connector as a whole, which includes the pressing terminal.

A second object of the invention is to provide a terminal pressing device capable of downsizing the pressing terminal and eventually capable of downsizing the electrical connector including the pressing terminal as a whole.

Further objects and advantages of the invention will be apparent from the following description of the invention.

SUMMARY OF THE INVENTION

In order to attain the first object described above, according to the present invention, a pressing terminal is to be connected to a mating terminal of a mating connector. The pressing terminal includes an outer conductive member to be connected to a mating outer conductive member of the mating terminal and an inner conductive member to be connected to a mating inner conductive member of the mating terminal. The pressing terminal further includes a dielectric member for holding the inner conductive member.

The outer conductive member includes a shield outer tube; a pressing tool insertion opening portion; and a shield wire pressing portion for pressing a shield wire. The inner conductive member includes a signal line pressing portion for pressing a signal line of the shield wire. The dielectric member includes a protruding portion fitted into the shield outer tube so that the signal line pressing portion is situated at the pressing tool insertion opening portion. The dielectric member holding the inner conductive member therein is inserted into the shield outer tube with the protruding portion thereof sliding against an inner surface of the shield outer tube.

With the configuration described above, when the inner conductive member is held in the shield outer tube via the dielectric member, the dielectric member holding the inner conductive member is forcibly inserted into the shield outer tube with the protruding portion thereof sliding and being ground against the inner surface of the shield outer tube. As a result, it is possible to eliminate a clearance between an outer circumference surface of the dielectric member and an inner circumference surface the shield outer tube. Therefore, a pressing piece of the signal line pressing portion of the inner conductive member can be situated in the pressing tool insertion opening portion without shifting from a center of the pressing tool insertion opening portion. As a result, it is possible to obtain a space for a wiring process precisely. Consequently, it is not necessary to design pressing tools (a signal line anvil and a signal line crimper) so that pressing teeth thereof do not interfere with the pressing piece. Accordingly, it is possible to downsize the pressing terminal. Eventually, it is possible to downsize a connector including such that pressing terminal (for example, a connector plug), and an electrical connector as a whole.

In addition, in the pressing terminal according to present invention, the protruding portion includes a plurality of protruding bands extending in a connecting direction of the pressing terminal. The protruding bands are situated on opposite surfaces of the dielectric member.

With the configuration described above, the dielectric member is well balanced in a right and left direction upon being forcibly inserted into the shield outer tube with the protruding portion thereof sliding and being ground against the inner surface of the shield outer tube. Consequently, it is possible to eliminate a clearance between the outer circumference surface of the dielectric member and an inner circumference surface of the shield outer tube more certainly.

In order to attain the second object described above, according to the present invention, a terminal pressing device is provided for pressing a pressing terminal to a shield wire. The pressing terminal includes an outer conductive member; an inner conductive member; and a dielectric member. The outer conductive member includes a shield outer tube; a pressing tool insertion opening portion; and a shield wire pressing portion for pressing the shield wire to the pressing terminal.

The inner conductive member includes a signal line pressing portion for pressing a signal line of the shield wire to the pressing terminal. The terminal pressing device includes an anvil unit for receiving the pressing terminal at a specific pressing position. The anvil unit includes a signal line anvil. The signal line anvil includes a terminal pressing anvil portion; a claw clamp portion; and a claw insertion groove portion disposed between the terminal pressing anvil portion and the claw clamp portion.

The terminal pressing device further includes a crimper unit for pressing the pressing terminal against the shield wire. The crimper unit includes a signal line crimper. Together with the signal line anvil, the signal line crimper swages a pressing piece of a signal line pressing portion of the inner conductive member in a pressing tool insertion opening portion. The signal line crimper includes a claw portion and a terminal pressing anvil insertion portion. The terminal pressing anvil insertion portion is situated between the claw portions and receives the terminal pressing anvil portion tightly.

When the terminal pressing anvil portion and the claw portion press the signal line pressing portion to attach a signal line of the shield wire, the claw portion is inserted into the claw insertion groove portion as well as the terminal pressing anvil portion is ushered to the terminal pressing anvil insertion portion. Therefore, it is possible to prevent the claw portion from being bent to open.

Further, the terminal pressing anvil portion includes a pressure receiving surface for abutting against the signal line pressing portion to receive a pressure of the signal line crimper when the signal line is attached. The pressure receiving surface is situated above a top surface of the claw clamp portion to support the signal line pressing portion so that the top surface of the claw clamp portion does not contact with a sidewall portion of the pressing tool insertion opening portion.

With the configuration described above, when the signal line is fixed by swaging the pressing piece of the signal line pressing portion with the signal line anvil portion and the signal line crimper, the terminal pressing anvil portion is ushered to the terminal pressing anvil insertion portion, thereby stabilizing a fixing position and a fixing form.

In addition, it is possible to prevent the pair of the claw portions from being bent to open since the pair of the claw portions of the signal line crimper is inserted into the claw insertion groove portion. Therefore, since durability of the signal line crimper can be improved, it is possible to prevent a tip portion of the signal line crimper from being broken and to make the tip portion of the signal line crimper finer. Thereby, the object to downsize the pressing terminal, the connector including such that pressing terminal (for example, the connector plug), and the electrical connector as a whole can be attained.

In addition, when the signal line is fixed at the signal line pressing portion in the pressing tool insertion opening portion, the sidewall portion of the pressing tool insertion opening portion can be an obstacle for providing the claw clamp portion. It is possible to provide the claw clamp portion since the pressure receiving surface of the terminal pressing anvil portion supports the signal line pressing portion so that the sidewall portion of the pressing tool insertion opening portion does not contact with the top surface of the claw clamp portion.

In addition, it is possible to prevent the pair of the claw portions from being bent to open since the pair of the claw portions of the signal line crimper is inserted into the claw insertion groove portion. Therefore, since durability of the signal line crimper can be improved, it is possible to prevent the tip portion of the signal line crimper from being broken and to make the tip portion of the signal line crimper finer. Consequently, it is possible to downsize the pressing terminal. Eventually, it is possible to downsize the connector plug, and the electrical connector.

Further, in the terminal pressing device according to the present invention, the signal line crimper further includes a thick wall portion so that the signal line crimper does not interfere with a middle dielectric member and an external covering of the shield wire when the signal line pressing portion is pressed by swaging the pressing piece of the signal line pressing portion.

With the configuration described above, durability of the signal line crimper can be improved. Consequently, it is possible to prevent the tip portion of the signal line crimper from being broken and to make the tip portion of the signal line crimper finer. Therefore, it is possible to downsize the pressing terminal. Eventually, it is possible to downsize the connector including such that pressing terminal (for example, the connector plug), and the electrical connector as a whole.

In the terminal pressing device according to the present invention, the anvil unit is arranged to receive the pressing terminal so that a protruding portion of the dielectric member is fitted into a shield outer tube of the outer conductive member and the signal line pressing portion is situated at the pressing tool insertion opening portion.

With the configuration described above, when the inner conductive member is held in the shield outer tube via the dielectric member, the dielectric member holding the inner conductive member is forcibly inserted into the shield outer tube with the protruding portion thereof sliding and being ground against the inner surface of the shield outer tube. Accordingly, it is possible to eliminate the clearance between the outer circumference surface of the dielectric member and the inner circumference surface the shield outer tube.

As a result, the pressing piece of the signal line pressing portion of the inner conductive member can be situated in the pressing tool insertion opening portion without shifting from the center of the pressing tool insertion opening portion.

The signal line crimper and the signal line anvil swage the pressing piece of the signal line pressing portion in the pressing tool insertion opening portion in such a state. Therefore, it is possible to obtain a precise space for a wiring process. Consequently, it is not necessary to design pressing tools (the signal line anvil and the signal line crimper) so that the pressing teeth thereof do not interfere with the pressing piece, in order to obtain the space for the wiring process. Accordingly, it is possible to downsize the pressing terminal. Eventually, it is possible to downsize the connector including such that pressing terminal (for example, a connector plug), and the electrical connector as a whole.

In the pressing terminal according to the present invention, when the inner conductive member is held in the shield outer tube via the dielectric member, the dielectric member holding the inner conductive member is forcibly inserted into the shield outer tube with the protruding portion thereof sliding and being ground against the inner surface of the shield outer tube. Accordingly, it is possible to eliminate the clearance between the outer circumference surface of the dielectric member and the inner circumference surface the shield outer tube by balancing in the right and left direction.

As a result, the pressing piece of the signal line pressing portion of the inner conductive member can be situated in the pressing tool insertion opening portion without shifting from the center of the pressing tool insertion opening portion. Therefore, it is possible to obtain the precise space for the wiring process. Consequently, it is not necessary to design pressing tools (a signal line anvil and a signal line crimper) so that pressing teeth thereof do not interfere with the pressing piece, in order to obtain the space for the wiring process precisely. Accordingly, it is possible to downsize the pressing terminal. Eventually, it is possible to downsize a connector including such that pressing terminal (for example, a connector plug), and an electrical connector as a whole.

In addition, in the terminal pressing device according to the present invention, when the signal line is fixed by swaging the pressing piece of the signal line pressing portion with the signal line anvil portion and the signal line crimper, the terminal pressing anvil portion is ushered to the terminal pressing anvil insertion portion, thereby stabilizing the fixing position and the fixing form.

In addition, it is possible to prevent the pair of the claw portions from being bent to open since the pair of the claw portions of the signal line crimper is inserted into a claw insertion groove portion. Therefore, since durability of the signal line crimper can be improved, it is possible to prevent a tip portion of the signal line crimper from being broken and to make the tip portion of the signal line crimper finer. Consequently, it is possible to downsize the pressing terminal. Eventually, it is possible to downsize the connector plug, and the electrical connector as a whole.

Further, when the signal line is fixed at the signal line pressing portion in the pressing tool insertion opening portion, it is necessary to provide the sidewall portion with a sufficient height and to situate the terminal pressing portion in the center of the pressing tool insertion opening portion in order to ensure electrical property of the pressing terminal. On the other hand, presence of the sidewall portion of the pressing tool insertion opening portion can be an obstacle for providing the claw clamp portion.

Since the pressure receiving surface of the terminal pressing anvil portion supports the signal line pressing portion so that the sidewall portion of the pressing tool insertion opening portion does not contact with the top surface of the claw clamp portion, it is possible to provide the claw clamp portion. In addition, it is possible to prevent the pair of the claw portions from being bent to open since the pair of the claw portions of the signal line crimper is inserted into the claw insertion groove portion. Therefore, since durability of the signal line crimper can be improved, it is possible to prevent the tip portion of the signal line crimper from being broken and to make the tip portion of the signal line crimper finer. Consequently, it is possible to downsize the pressing terminal. Eventually, it is possible to downsize the connector including such that pressing terminal (for example, a connector plug), and the electrical connector as a whole.

Furthermore, in the terminal pressing device according to the present invention, durability of the signal line crimper can be improved. Therefore, it is possible to prevent the tip portion of the signal line crimper from being broken and to make the tip portion of the signal line crimper finer. Consequently, it is possible to downsize the pressing terminal. Eventually, it is possible to downsize the connector including such that pressing terminal (for example, a connector plug), and the electrical connector as a whole.

Moreover, in the terminal pressing device according to the present invention, when the inner conductive member is held in the shield outer tube via the dielectric member, the dielectric member holding the inner conductive member is forcibly inserted into the shield outer tube with a protruding portion thereof sliding and being ground against the inner surface of the shield outer tube.

Accordingly, it is possible to eliminate the clearance between the outer circumference surface of the dielectric member and the inner circumference surface the shield outer tube. As a result, the pressing piece of the signal line pressing portion of the inner conductive member can be situated in the pressing tool insertion opening portion without shifting from the center of the pressing tool insertion opening portion.

The signal line crimper and the signal line anvil swage the pressing piece of the signal line pressing portion in the pressing tool insertion opening portion in such a state. Therefore, it is possible to obtain the precise space for the wiring process. Consequently, it is not necessary to design pressing tools (the signal line anvil and the signal line crimper) so that the pressing teeth thereof do not interfere with the pressing piece, in order to obtain the space for the wiring process. Accordingly, it is possible to downsize the pressing terminal. Eventually, it is possible to downsize the connector including such that pressing terminal (for example, the connector plug), and the electrical connector as a whole.

DETAILED DESCRIPTIONS OF THE PREFERRED EMBODIMENTS

Embodiments of the present invention will be explained with reference to the accompanying drawings.

When an inner conductive member is held in a shield outer tube via a dielectric member, the dielectric member holding the inner conductive member is forcibly inserted into the shield outer tube with a protruding portion thereof sliding and being ground against an inner surface of the shield outer tube. Accordingly, it is possible to eliminate a clearance between an outer circumference surface of the dielectric member and an inner circumference surface the shield outer tube. As a result, it is possible to obtain a space for a wiring process precisely. Consequently, it is not necessary to design pressing tools (a signal line anvil and a signal line crimper) so that pressing teeth thereof do not interfere with the pressing piece. Accordingly, it is possible to downsize the pressing terminal. Thereby, an object to downsize the pressing terminal, the connector including such that pressing terminal (for example, the connector plug), and the electrical connector as a whole can be attained.

When a signal line is attached by swaging the pressing piece of a signal line pressing portion with a signal line anvil portion and the signal line crimper, the terminal pressing anvil portion is ushered to a terminal pressing anvil insertion portion, thereby stabilizing a fixing position and a fixing form. In addition, it is possible to prevent the pair of the claw portion 43 from being bent to open since a pair of claw portions of the signal line crimper is inserted into a claw insertion groove portion. Therefore, since durability of the signal line crimper can be improved, it is possible to prevent a tip portion of the signal line crimper from being broken and to make the tip portion of the signal line crimper finer. Thereby, the object to downsize the pressing terminal, the connector including such that pressing terminal (for example, the connector plug), and the electrical connector as a whole can be attained.

Hereunder, referring to the accompanying drawings, embodiments of the invention will be described.

Figure 1:
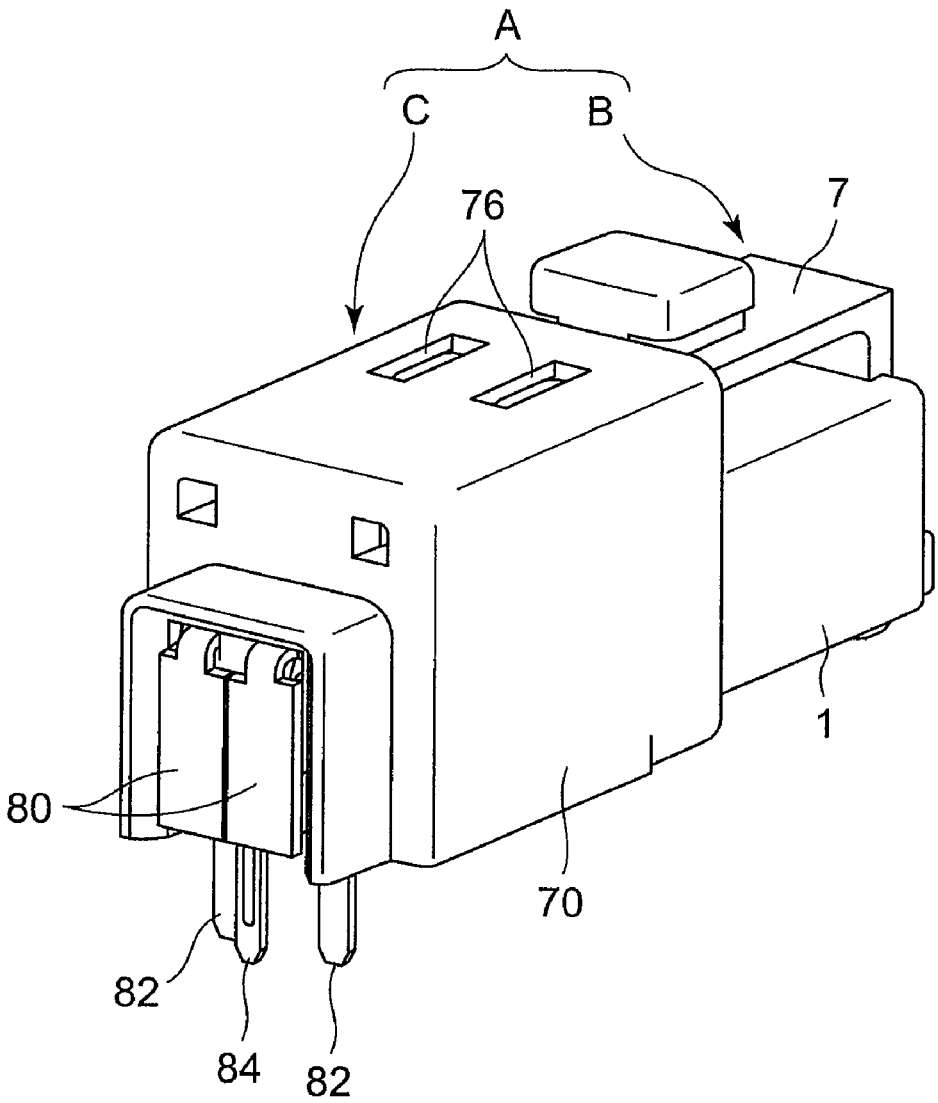
FIG. 1 is a perspective view showing an electrical connector including a connector plug and a connector socket according to an embodiment of the invention, wherein said connector plug and said connector socket are connected to each other.
Figure 2:
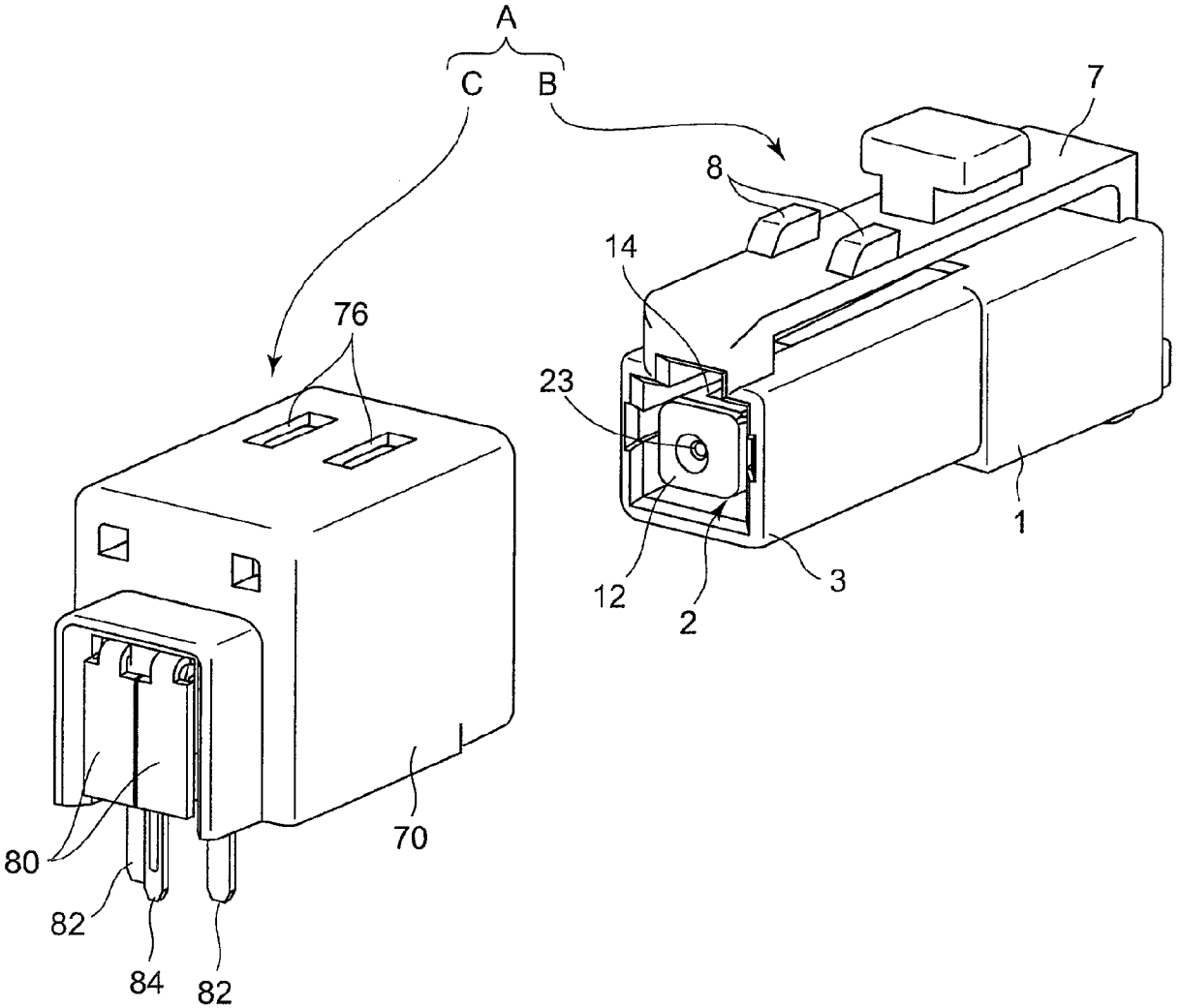
FIG. 2 is a perspective view showing the electrical connector according to the embodiment of the invention, wherein the connector plug and the connector socket are not connected to each other.

As shown in FIGS. 1 and 2, an electrical connector A includes a connector plug B and a connector socket C. The connector plug B includes a plug insulating housing 1 and further includes an electrical contacting terminal or a pressing terminal 2 in the plug insulating housing 1. The pressing terminal 2 is a terminal of the connector plug B for making an electrical contact.

Figure 5:
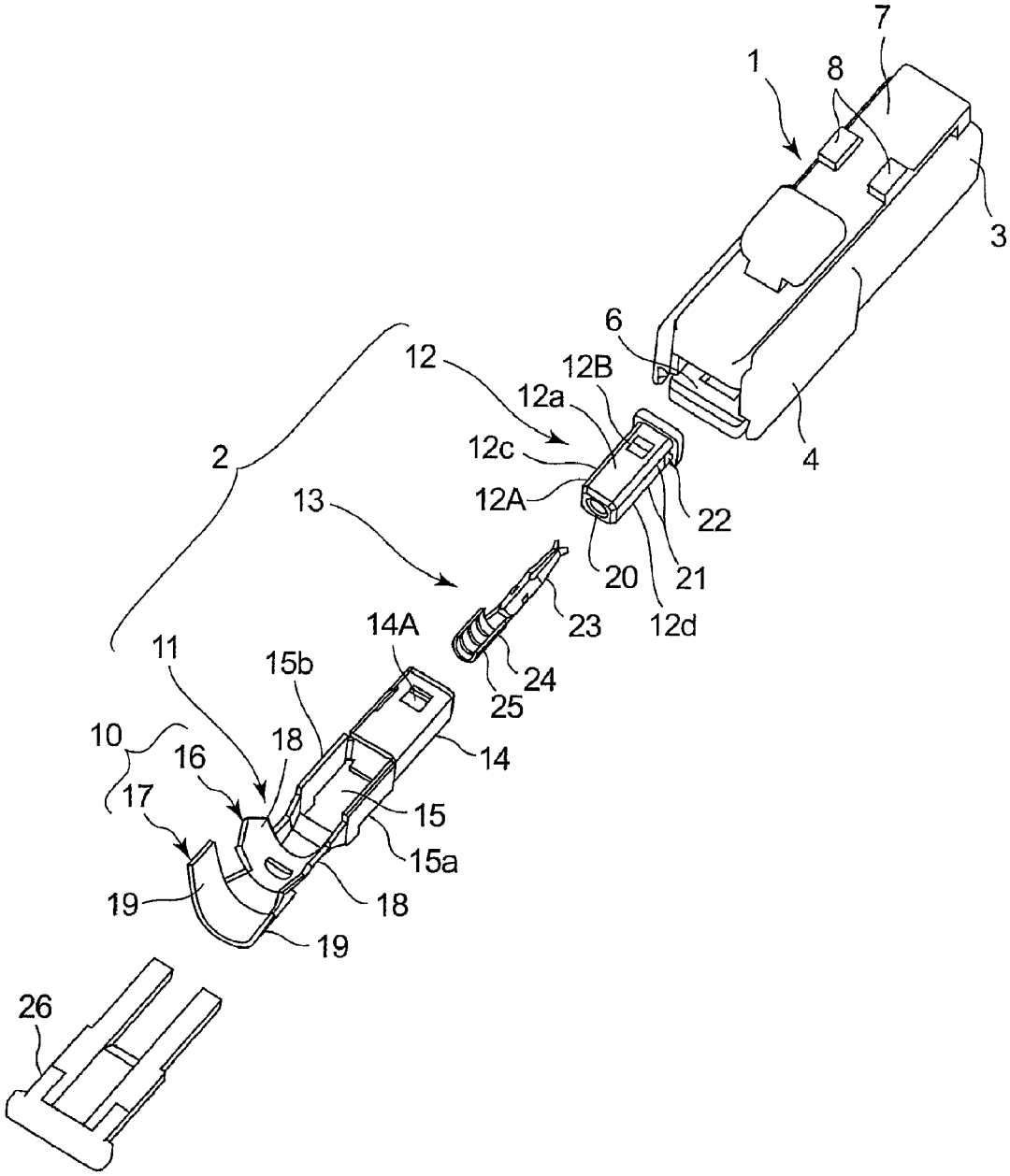
FIG. 5 is a perspective view showing the connector plug in a disassembled state according to the embodiment of the invention of another embodiment of the invention.
Figure 6:
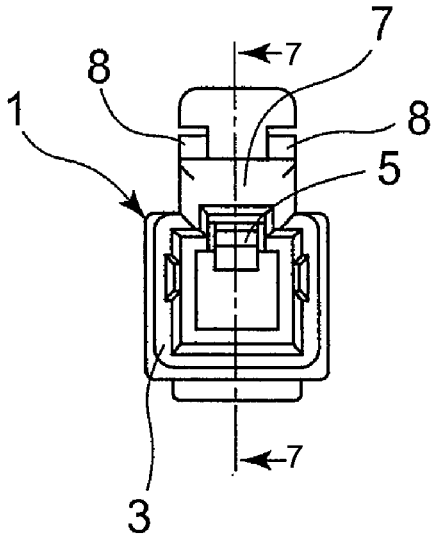
FIG. 6 is a front view showing a plug insulating housing according to the embodiment of the invention.
Figure 7:
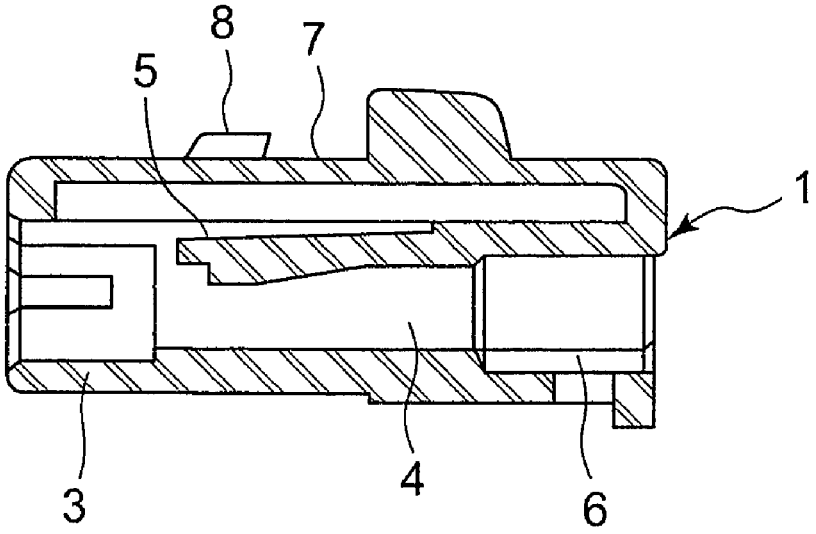
FIG. 7 is a sectional view showing the plug insulating housing taken along a line 7-7 in FIG. 6 according to the embodiment of the invention.

As shown in FIGS. 5, 6 and 7, the plug insulating housing 1 includes a plug connecting portion 3 and a pressing terminal insertion portion 4. The plug connecting portion 3 has a rectangular frame shape as seen in a longitudinal direction thereof. An end portion of the pressing terminal insertion portion 4 is connected to an inner portion of the plug connecting portion 3. The pressing terminal insertion portion 4 includes a lance portion 5 in an upper inner surface thereof. The lance portion 5 has a cantilever shape. Further, the pressing terminal insertion portion 4 includes a retainer insertion portion 6. And the plug insulating housing 1 further includes a lock lever 7. A lock engaging protrusion 8 is provided in the lock lever 7 with a protruding manner.

As shown in FIG. 5, the pressing terminal 2 includes an outer conductive member 11; a dielectric member 12; and an inner conductive member 13. The outer conductive member 11 includes a shield outer tube 14; a pressing tool insertion opening portion 15; a shield pressing portion 16; and an external covering pressing portion 17. In addition, a shield wire pressing portion 10 is composed of the shield pressing portion 16 and the external covering pressing portion 17.

Figure 9:
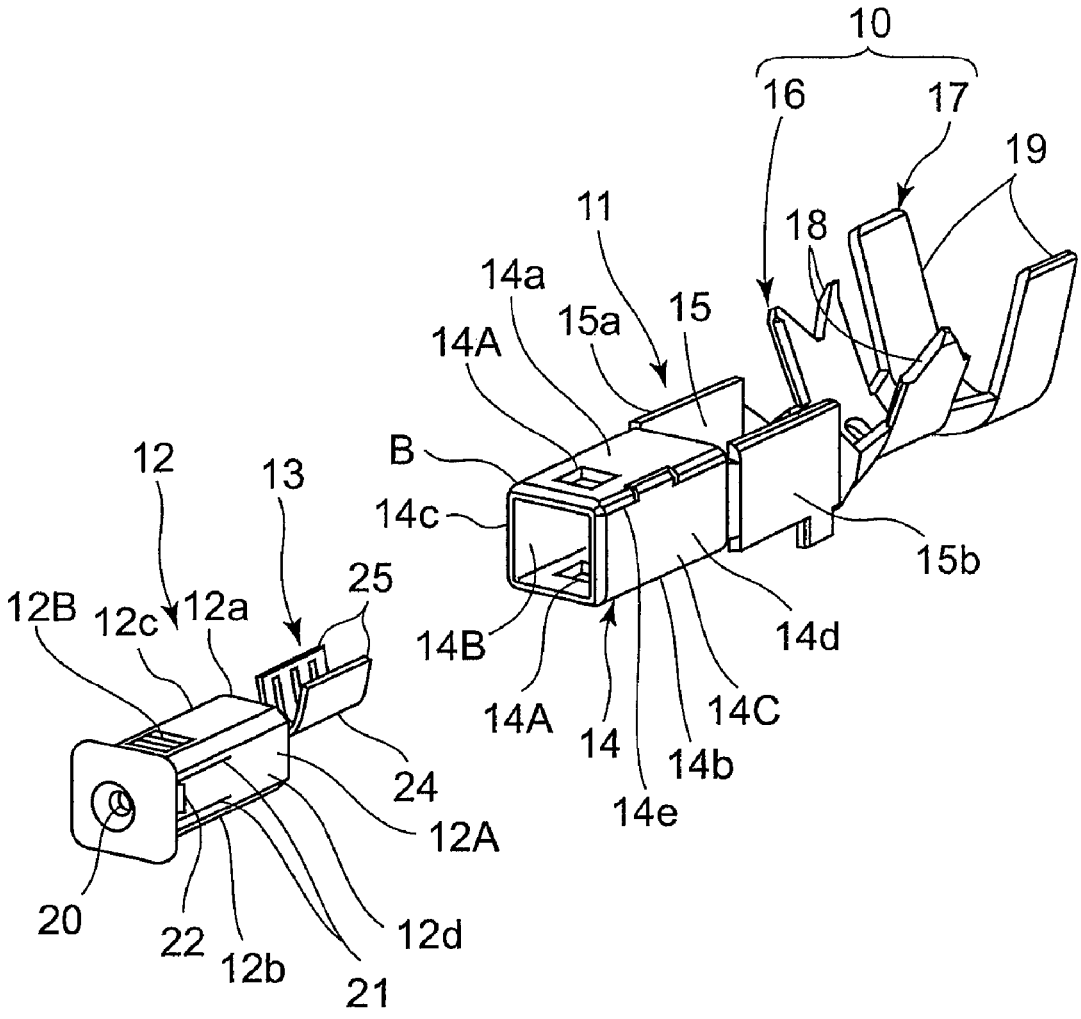
FIG. 9 is a perspective view showing the mating pressing terminal in a disassembled state according to the embodiment of the invention.
Figure 10:
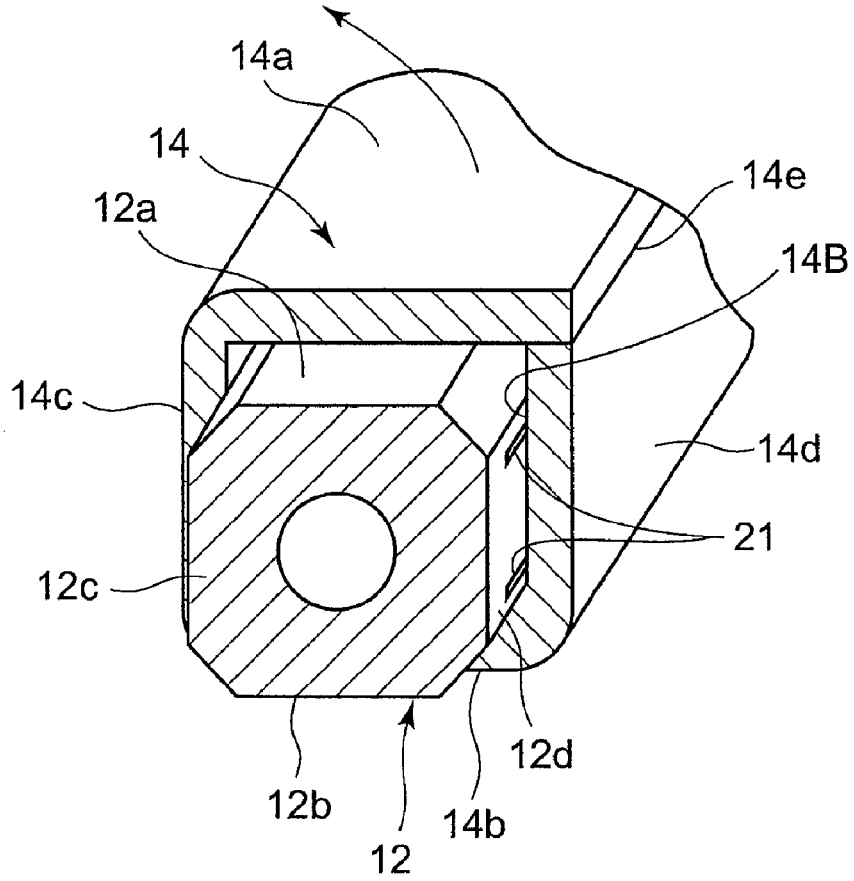
FIG. 10 is a partial perspective view showing a state that a dielectric member is forcibly inserted into a shield outer tube according to the embodiment of the invention.

As shown in FIG. 9, the shield outer tube 14 has a rectangular cross-sectional shape. Further, a dielectric member engaging hole 14A is provided on an upper surface portion 14*a* and a lower surface portion 14*b* of the shield outer tube 14. In addition, outer surfaces of both sidewall portions 14*c* and 14*d* of the shield outer tube 14 are formed as a terminal contacting portion 14C and inner surfaces of the sidewall portions 14*c* and 14*d* are formed as a terminal fitting portion 14B. The upper surface portion 14*a* and the sidewall portion 14*c* are connected continuously while the upper surface portion 14*a* and the sidewall portion 14*d* are not connected continuously. As shown in FIGS. 9 and 10, an end portion of the upper surface portion 14*a* contacts an end portion of the sidewall portion 14*d*, thereby forming a joint portion 14*e*.

In addition, as shown in FIGS. 5 and 9, the pressing tool insertion opening portion 15 includes sidewall portions 15*a* and 15*b* in both side portions thereof. The sidewall portions 15*a* and 15*b* are connected continuously with the sidewall portions 14*c* and 14*d* of the shield outer tube 14 with end portions situated at one side thereof, respectively. The end portions of the sidewall portions 15*a* and 15*b* situated at other side thereof are connected continuously with the shield pressing portion 16. The shield pressing portion 16 includes a pressing piece 18. The pressing piece 18 is a terminal barrel having a U-letter shape opening in an upper direction. In addition, the external covering pressing portion includes a hold pressing piece 19. The hold pressing piece 19 is a terminal barrel with a U-letter shape opening in the upper direction.

As shown in FIGS. 5 and 9, the dielectric member 12 includes a dielectric member main body 12A having a rectangular cross-sectional shape. An inner conductive member insertion hole 20 is provided through a central portion of the dielectric member main body 12A. In addition, as shown in FIG. 9, the dielectric member main body 12A includes an engaging protrusion 12B on both of an upper surface portion 12*a* and a lower surface portion 12*b*. Further, both side surface portions 12*c* and 12*d* have a protruding portion 21, respectively. The protruding portion 21 is a pair of two protrusions extending in parallel. The protruding portion 21 extends protruding from a front end portion (a portion situated at a left side in FIG. 9) to a middle portion of the dielectric member main body 12A, that is, extends protruding in a connecting direction of the electrical connector 1. Furthermore, a side hole portion 22 is provided at the front end portion of the dielectric member main body 12A so as to crossover the inner conductive member insertion hole 20.

As shown in FIG. 5, the inner conductive member 13 includes a contact portion 23 and a signal line pressing portion 24. The signal line pressing portion 24 includes a pressing piece 25 which is a terminal barrel with a U-letter shape opening in the upper direction.

Figure 8:
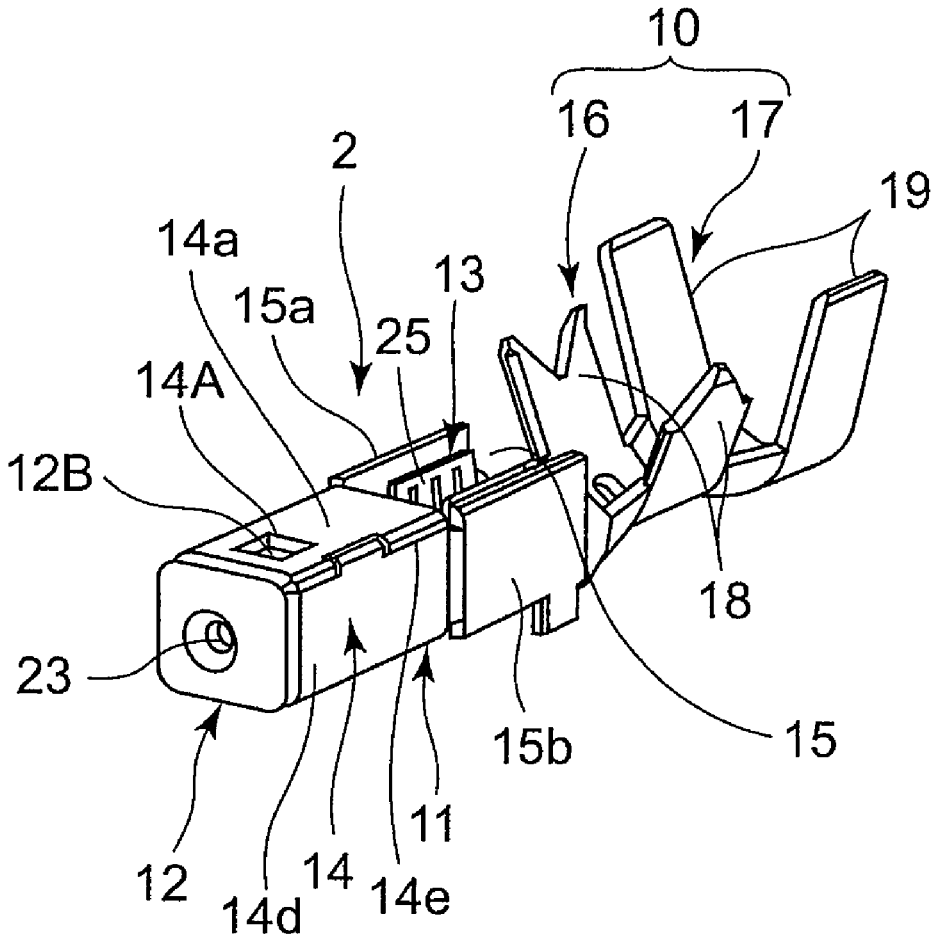
FIG. 8 is a perspective view showing a mating pressing terminal according to the embodiment of the invention.

The contact portion 23 of the inner conductive member 13 is forcibly inserted into the inner conductive member insertion hole 20 of the dielectric member 12, thereby attaching the inner conductive member 13 to the dielectric member 12. Further, the dielectric member 12 is forcibly inserted into the shield outer tube 14 of the outer conductive member 11. As shown in FIG. 10, the dielectric member 12 is inserted as the protruding portion 21 thereof slides being ground against the terminal fitting portion 14B of the shield outer tube 14. Then, as shown in FIG. 8, the engaging protrusion 12B of the dielectric member 12 engages the dielectric member engaging hole 14A of the shield outer tube 14. Thereby, the inner conductive member 13 is held in the shield outer tube 14 via the dielectric member 12.

When the engaging protrusion 12B engages the dielectric member engaging hole 14A, the joint member 14*e* is opened and the upper surface portion 14*a* is lifted in a direction shown with an arrow in FIG. 10 by a little amount. Accordingly, the engaging protrusion 12B is able to enter the dielectric member engaging hole 14A. As a result, a distance between the sidewall portions 14*c* and 14*d* is hardly widened. Therefore, the protruding portion 21 does not receive any impact upon sliding against the terminal fitting portion 14B.

As described above, it is possible to eliminate a clearance between the dielectric member 12 and the shield outer tube 14A since the protruding portion 21 slides against the terminal fitting portion 14B upon being inserted. As a result, the signal line pressing portion 24 of the inner conductive member 13 can be situated in a center of the pressing tool insertion opening portion 15. Accordingly, it is possible to obtain a space for a wiring process, described later, precisely.

Figure 13:
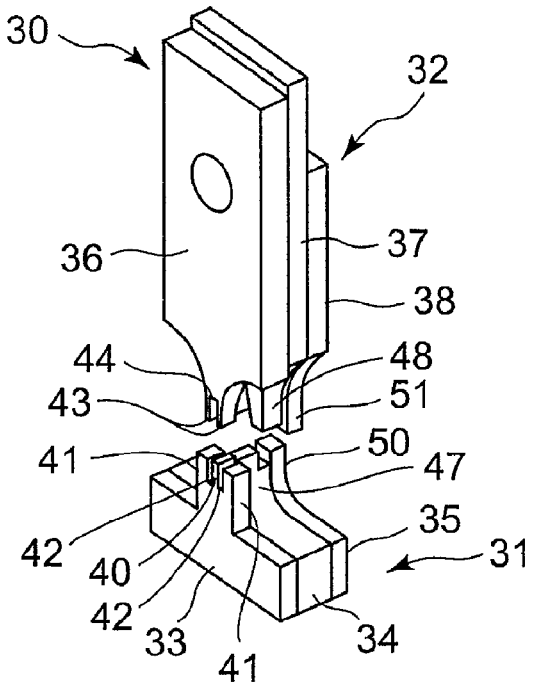
FIG. 13 is a perspective view showing a pressing tool according to the embodiment of the invention.
Figure 14:
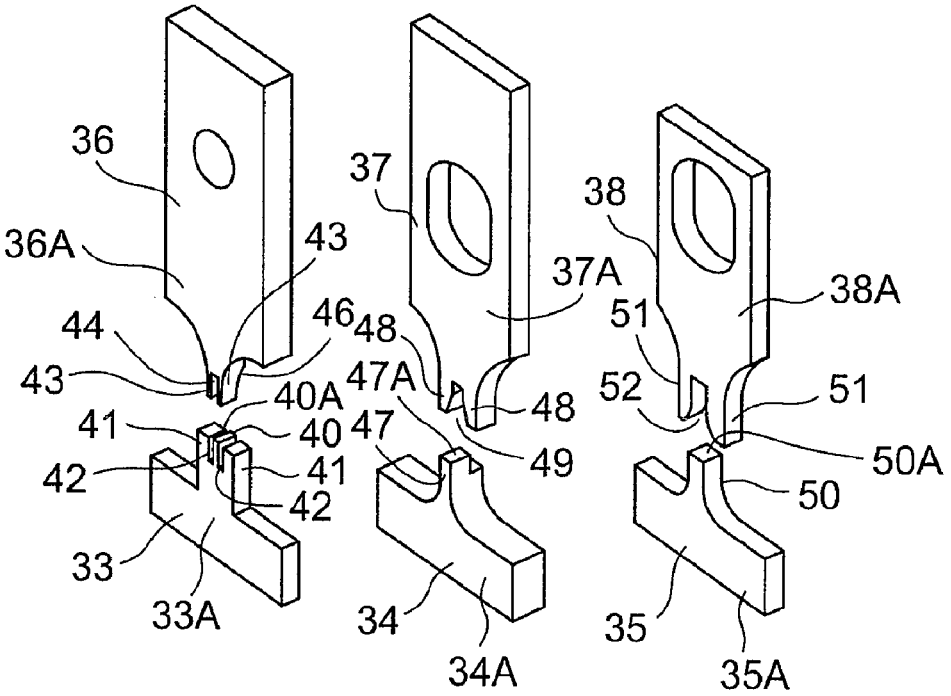
FIG. 14 is a perspective view showing the pressing tool in a disassembled state according to the embodiment of the invention.
Figure 17:
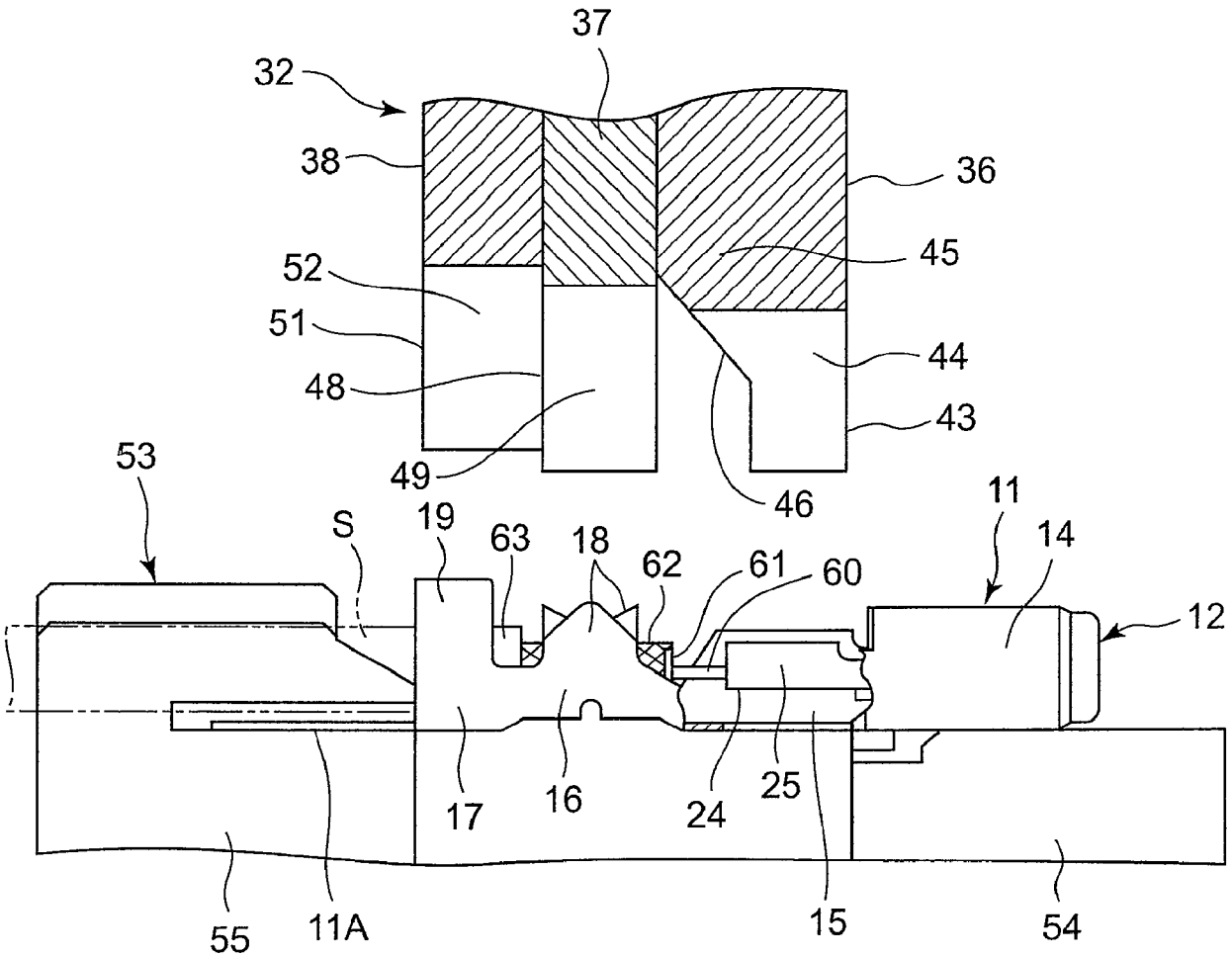
FIG. 17 is a sectional view showing the signal line crimper and the pressing terminal set in a pressing terminal placing portion according to the embodiment of the invention.

As shown in FIGS. 13 and 14, a terminal pressing device 30 includes a pressure receiving portion for placing the pressing terminal 2 at a specific pressing position thereof, for receiving a pressure; a pressure applying portion for pressing and attaching the pressing terminal 2 to an end portion of a shield wire S supplied by a covered wire supplying structure (not shown) by applying the pressure; and a pressing terminal placing portion 53 for placing the pressing terminal 2 thereon (refer to FIG. 17). In addition, the pressure receiving portion includes an anvil unit 31 and the pressure applying portion includes a crimper unit 32.

The anvil unit 31 includes a signal line anvil 33; a shield anvil 34; and an external covering anvil 35. The crimper unit 32 includes a signal line crimper 36; a shield crimper 37; and an external covering crimper 38. The signal line anvil 33 and the signal line crimper 36 swage the pressing piece 25 of the signal line pressing portion 24. The shield anvil 34 and the shield crimper 37 swage the pressing piece 18 of the shield pressing portion 16. The external covering anvil 35 and the external covering crimper 38 swage the hold pressing piece 19 of the external covering pressing portion 17.

Figure 15:
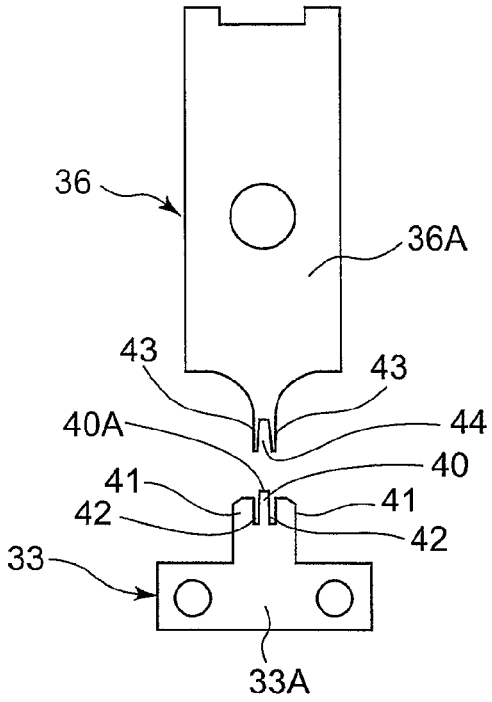
FIG. 15 is a front view showing a signal line anvil and a signal line crimper, according to the embodiment of the invention.

As shown in FIG. 15, the signal line anvil 33 includes an anvil main body 33A. The anvil main body 33A includes a terminal pressing anvil portion 40 as a pressing tooth; a claw clamp portion 41 situated on both sides of the terminal pressing anvil portion 40 and a claw insertion groove portion 42 disposed between the terminal pressing anvil portion 40 and the claw clamp portion 41. The claw clamp portion 41 prevents the signal line crimper 36 from being bent to open by clamping a claw portion 43 of the signal line crimper 36 with the terminal pressing anvil portion 40.

Figure 16:
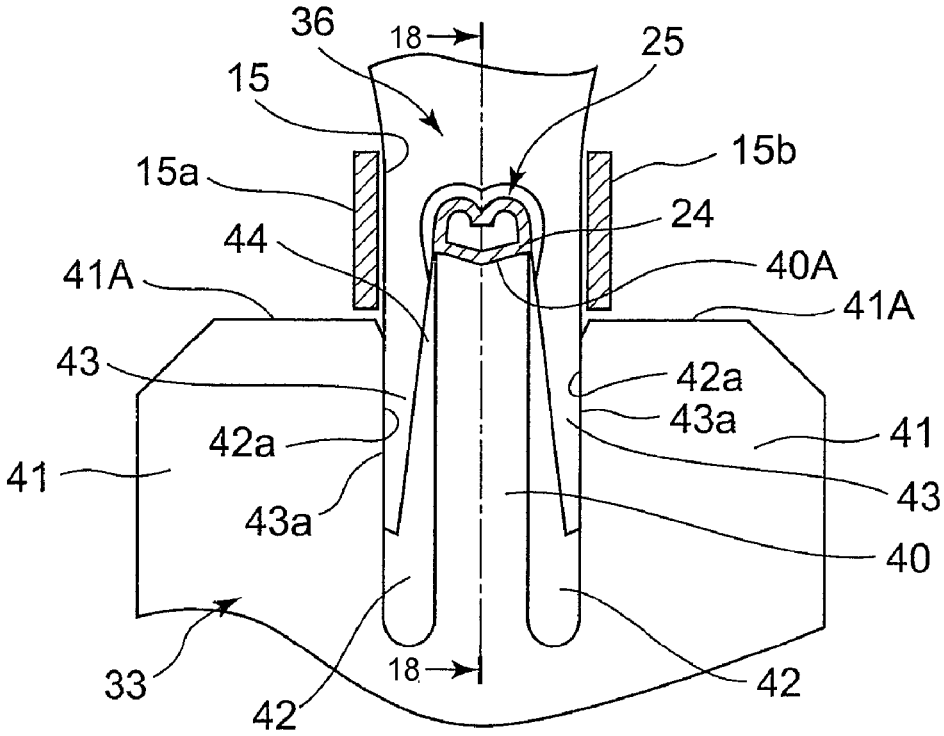
FIG. 16 is a partial enlarged front view showing the signal line anvil and the signal line crimper in a state of pressing a signal line of an electrical wire according to the embodiment of the invention.

Furthermore, as shown in FIGS. 15 and 16, a pressure receiving surface 40A is formed on a top surface of the terminal pressing anvil portion 40. When the pressing piece 25 of the signal line pressing portion 24 of the inner conductive member 13 is swaged, the pressure receiving surface 40A abuts against an outer surface of the signal line pressing portion 24 and receives a load of swaging from the signal line crimper 36. In addition, as shown in FIG. 16, the pressure receiving surface 40A is situated above a top surface 41A of the claw clamp portion 41. Accordingly, the pressure receiving surface 40A supports the signal line pressing portion 24 so that both sidewall portions 15*a* and 15*b* of the pressing tool insertion opening portion 15 do not contact with the top surface 41A of the claw clamp portion 41.

Figure 18:
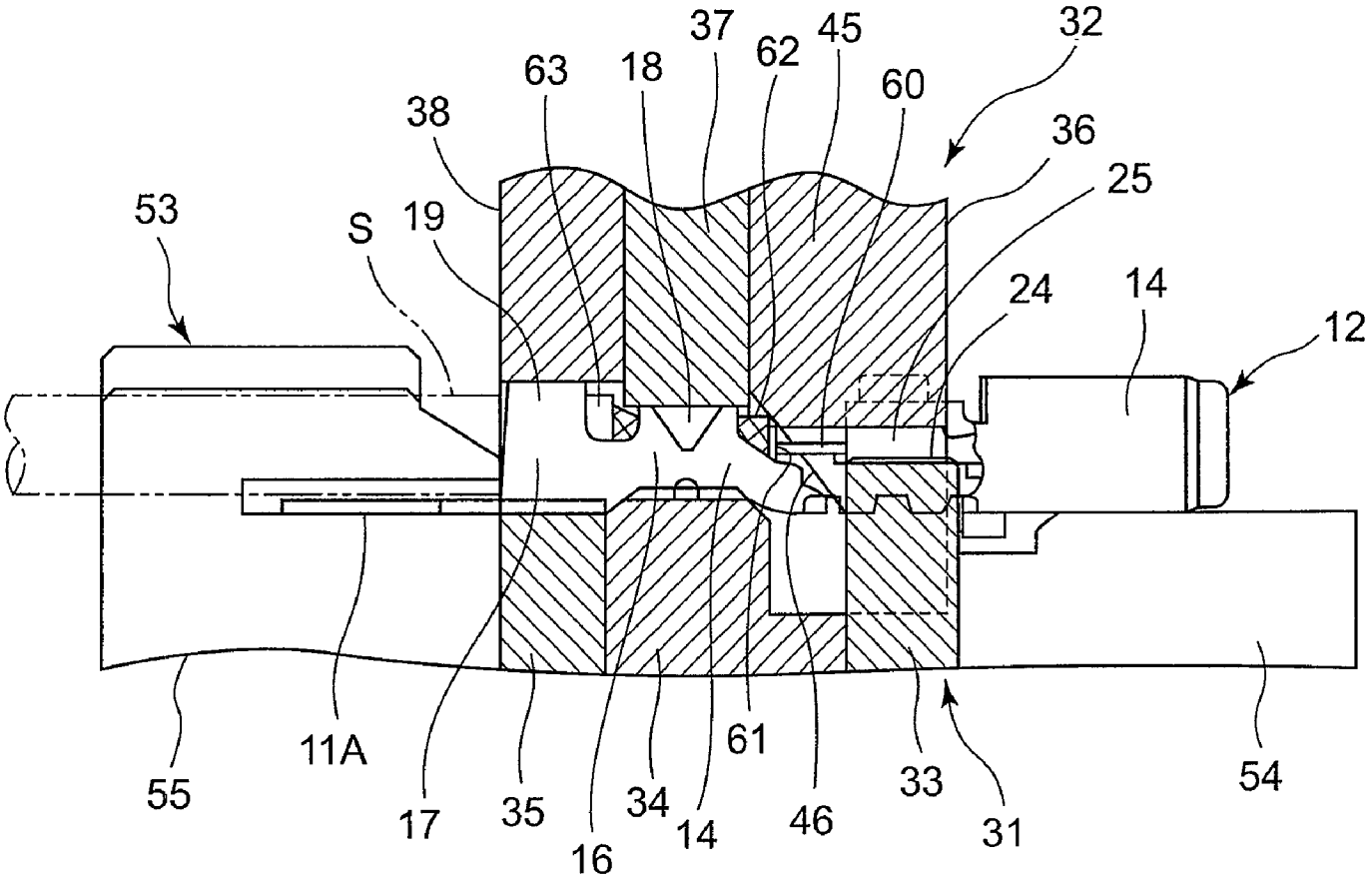
FIG. 18 is a sectional view taken along a line 18-18 in FIG. 16 according to the embodiment of the invention.
Figure 19:
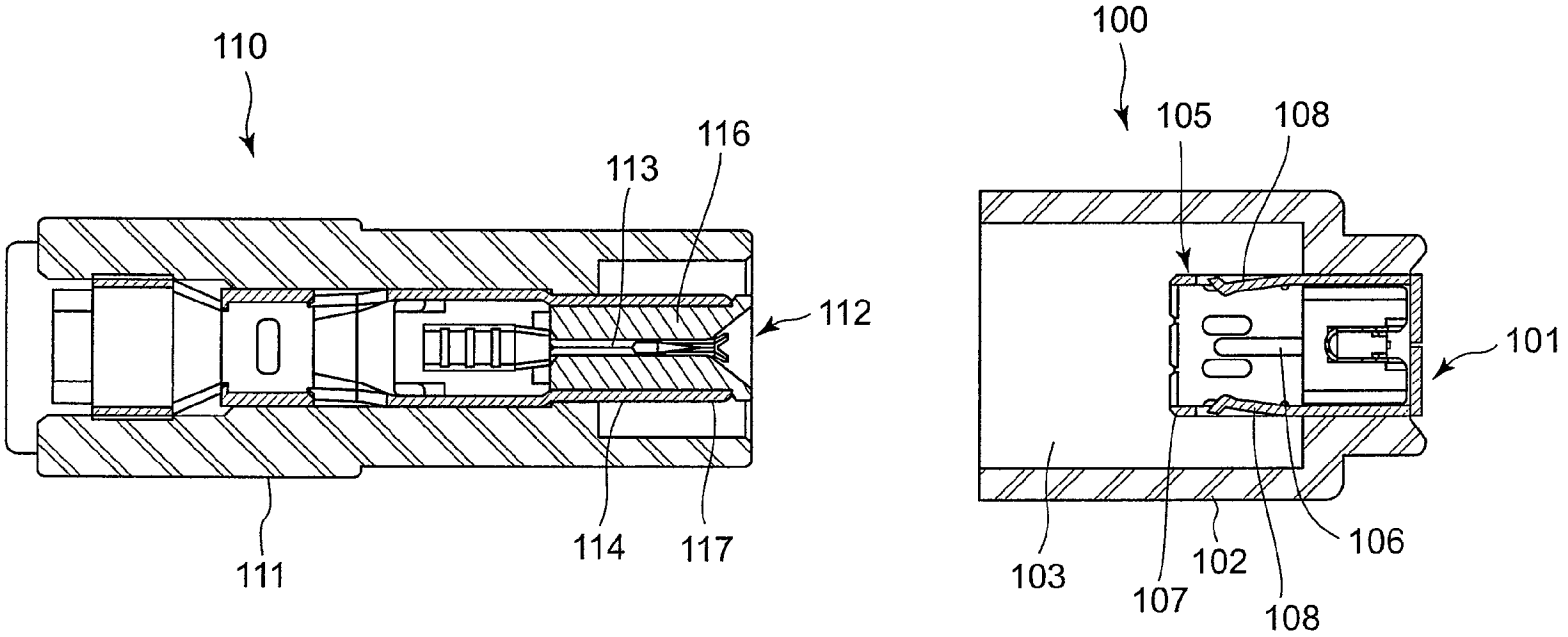
FIG. 19 PRIOR ART
FIG. 19 is a sectional view showing a conventional electrical connector including a connector plug and a connector socket, in a state that the connector plug and the connector socket are not connected to each other.
Figure 20:
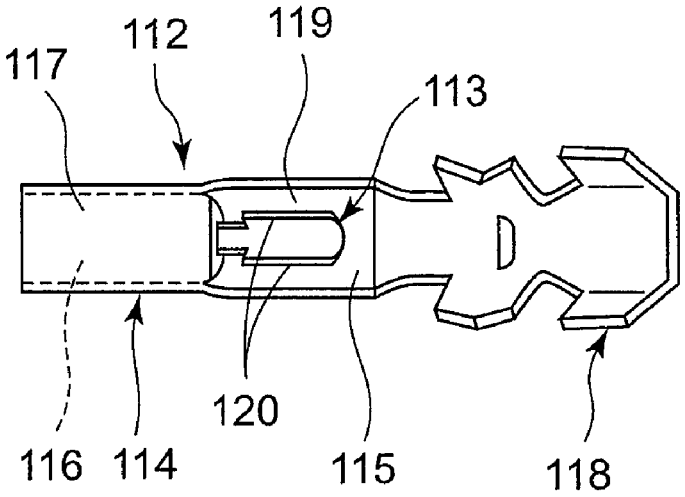
FIG. 20 PRIOR ART
FIG. 20 is a plan view showing a conventional pressing terminal.
Figure 21:
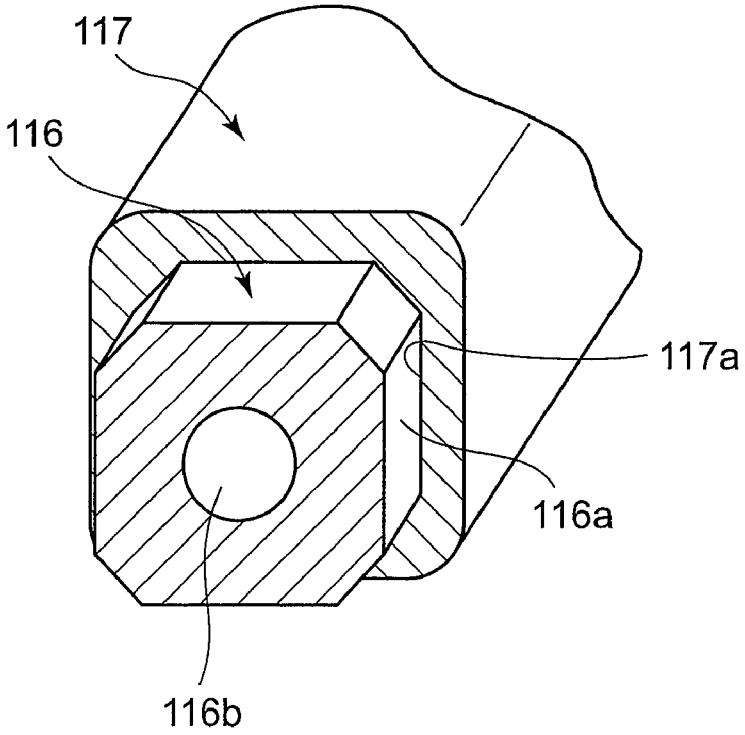
FIG. 21 PRIOR ART
FIG. 21 is a partial perspective view showing a state that a dielectric member is forcibly inserted into a shield outer tube according to the conventional electrical connector.
Figure 22:
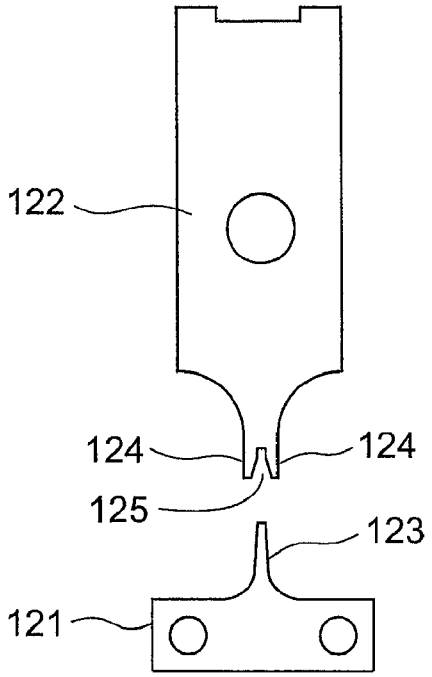
FIG. 22 PRIOR ART
FIG. 22 is a front view showing a signal line anvil and a signal line crimper according to the conventional electrical connector.
Figure 23:
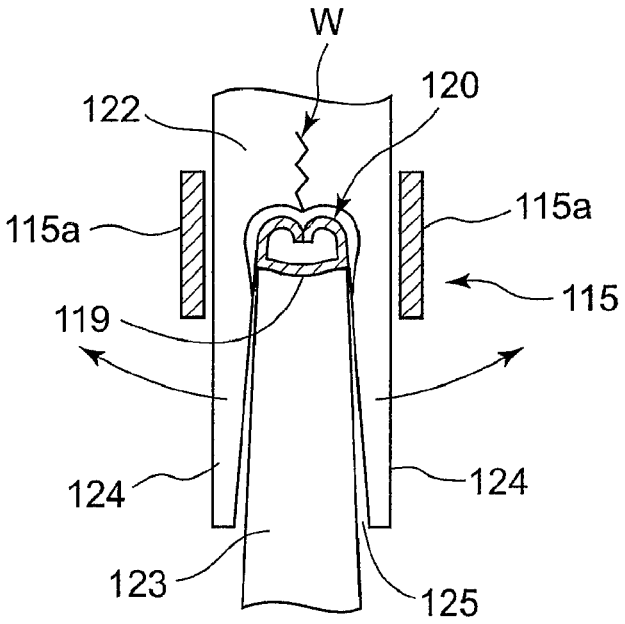
FIG. 23 PRIOR ART
FIG. 23 is a partial enlarged front view showing the signal line anvil and the signal line crimper in a state of pressing a signal line of an electrical wire according to the conventional electrical connector.

In addition, as shown in FIG. 15, the signal line crimper 36 includes a crimper main body 36A. The crimper main body 36A includes a pair of the claw portions 43 as pressing teeth and a terminal pressing anvil insertion portion 44. The terminal pressing anvil insertion portion 44 is situated between the claw portions 43, and is capable of receiving the terminal pressing anvil portion 40 of the signal line anvil 33 tightly. As shown in FIG. 17, the signal line crimper 36 includes a thick wall portion or a thicker portion 45 in a portion thereof except a forefront side portion than a substantially central portion of the pair of the claw portions 43. The thicker portion 45 includes a slanting surface portion 46 on a side of the claw portion 43. With the slanting surface portion 46, as shown in FIG. 18, the signal line crimper 36 does not interfere with a middle dielectric member 61 and a shield 62 of the shield wire S upon swaging the pressing piece 25 of the signal line pressing portion 24.

As shown in FIG. 14, the shield anvil 34 includes an anvil main body 34A. The anvil main body 34A includes a terminal pressing anvil portion 47 as a pressing tooth. A pressure receiving surface 47A is formed on a top surface of the terminal pressing anvil portion 47. When the pressing piece 18 of the shield pressing portion 16 of the outer conductive member 11 is swaged, the pressure receiving surface 47A abuts against an outer surface of the shield pressing portion 16 and receives a load of swaging from the shield crimper 37.

In addition, as shown in FIG. 14, the shield crimper 37 includes a crimper main body 37A. The crimper main body 37A includes a pair of claw portions 48 as pressing teeth and a terminal pressing anvil insertion portion 49. The terminal pressing anvil insertion portion 49 is situated between the claw portions 48, and is capable of receiving the terminal pressing anvil portion 47 of the shield anvil 34 tightly.

Further, as shown in FIG. 14, the external covering anvil 35 includes an anvil main body 35A. The anvil main body 35A includes a terminal pressing anvil portion 50. A pressure receiving surface 50A is formed on a top surface of the terminal pressing anvil portion 50. When the hold pressing piece 19 of the external covering pressing portion 17 of the outer conductive member 11 is swaged, the pressure receiving surface 50A abuts against an outer surface of the external covering pressing portion 17 and receives a load of swaging from the external covering crimper 38.

Furthermore, as shown in FIG. 14, the external covering crimper 38 includes a crimper main body 38A. The crimper main body 38A includes a pair of claw portions 51 as pressing teeth and a terminal pressing anvil insertion portion 52. The terminal pressing anvil insertion portion 52 is provided between the claw portions 51, and is capable of receiving the terminal pressing anvil portion 50 of the external covering anvil 35 tightly.

As shown in FIG. 13, the signal line anvil 33, the shield anvil 34 and the external covering anvil 35 are united and tightened, thereby configuring the anvil unit 31.

In addition, as shown in FIG. 13, the signal line crimper 36, the shield crimper 37 and the external covering crimper 38 are united and tightened, thereby configuring the crimper unit 32.

Further, as shown in FIG. 17, the pressing terminal placing portion 53 is configured with a shield outer tube holding member 54 for holding the shield outer tube 14 of the outer conductive member 11 and a carrier holding member 55 for holding a carrier 11A of the outer holding member 11.

Next, it will be explained that an operation of attaching the pressing terminal 2 to the end portion of the shield wire S with the terminal pressing device 30 described above.

As described above, in the pressing terminal 2, when the dielectric member 12 is forcibly inserted into the shield outer tube 14, the protruding portion 21 slides against the terminal fitting portion 14B. Therefore, the clearance between the dielectric member 12 and the shield outer tube 14 is eliminated. As a result, the signal line pressing portion 24 of the inner conductive member 13 can be situated in the pressing tool insertion opening portion 15 without shifting from the center of the pressing tool insertion opening portion 15.

Figure 11:
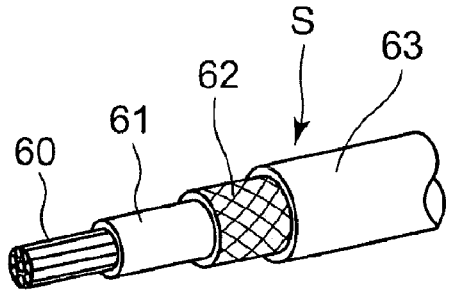
FIG. 11 is a partial view showing a forefront portion of a shield wire, describing a configuration of a shield wire according to the embodiment of the invention.

As shown in FIG. 11, the shield wire S to be attached to the pressing terminal 2 is fabricated at a forefront portion thereof so as to expose a signal line 60, a middle dielectric member 62 and the shield 62 from an external covering 63.

Next, as shown in FIG. 17, the signal line 60 of the shield wire S is inserted and disposed between the pressing pieces 25 of the signal line pressing portion 24 of the inner conductive member 13. Further, the shield 62 of the shield wire S is inserted and disposed between the pressing pieces 18 of the shield pressing portion 16 of the outer conductive member 11. In addition, the external covering 63 of the shield wire S is inserted and disposed between the hold pressing pieces 19 of the external covering pressing portion 17 of the outer conductive member 11.

As shown in FIG. 17, the pressing terminal 2 is set in the pressing terminal placing portion 53 and the carrier 11A of the outer conductive member 11 is held with the carrier holding member 55. As a result, the pressure receiving surface 40A of the terminal pressing anvil portion 40 of the signal line anvil 33 faces the outer surface of the signal line pressing portion 24 of the inner conductive member 13; the pressure receiving surface 47A of the terminal pressing anvil portion 47 of the shield anvil 34 faces the outer surface of the shield pressing portion 16 of the outer conductive member 11; and the pressure receiving surface 50A of the terminal pressing anvil portion 50 of the external covering anvil 35 faces the outer surface of the external covering pressing portion 17 of the outer conductive member 11. At this time, the shield outer tube holding member 54 may hold the shield outer tube 14 of the outer conductive member 11.

Note that the terminal pressing anvil portion 40 of the signal line anvil 33 is situated in a lower opening portion of the pressing tool insertion opening portion 15. The pressure receiving surface 40A of the terminal pressing anvil portion 40 and the outer surface of the signal line pressing portion 24 of the inner conductive member 13 has a space therebetween, as wide as the sidewall portions 15*a* and 15*b* of the pressing tool insertion opening portion 15 do not interfere with the terminal pressing anvil portion 40.

As shown in FIG. 18, maintaining a state described above, the crimper unit 32 is moved toward the pressing terminal 2, thereby starting the wiring process. First, the signal line crimper 36 is inserted into the pressing tool insertion opening portion 15 from an upper opening portion of the pressing tool insertion opening portion 15. Then the signal line crimper 36 and the pressure receiving surface 40A of the terminal pressing anvil portion 40 sandwich the signal line pressing portion 24. Then the pressing piece 25 of the signal line pressing portion 24 is swaged. Thereby, the signal line 60 is attached to the terminal pressing portion 24. As shown in FIG. 16, the pressure receiving surface 40A of the terminal pressing anvil portion 40 of the signal line anvil 33 is situated above the top surface 41A of the claw clamp portion 41 and supports the signal line pressing portion 24 so that the both sidewall portions 15*a* and 15*b* of the pressing tool insertion opening portion 15 do not contact with the top surface 41A of the claw clamp portion 41.

In addition, as shown in FIG. 16, the terminal pressing anvil portion 40 of the signal line anvil 33 is tightly inserted between the terminal pressing anvil insertion portion 44 of the signal line crimper 36. The pair of the claw portions 43 of the signal line crimper 36 is inserted into the claw insertion groove portion 42 and an outer surface 43*a* of the pair of the claw portion 43 abut against an outer surface 42*a* of the claw insertion groove portion 42. Thereby, it is possible to prevent the signal line crimper 36 from being bent to open, by suppressing an opening force with the pair of the claw clamp portions 41.

Further, as shown in FIGS. 17 and 18, the signal line crimper 36 can obtain strength since the signal line crimper 36 includes the thicker portion 45 in the portion thereof except the forefront side portion of the substantially central portion of the pair of the claw portions 43. In addition, the thicker portion 45 includes the slanting surface portion 46 on the side of the claw portion 43. Therefore, the signal line crimper 36 does not interfere with the middle dielectric member 61 and the shield 62 of the shield wire S.

Next, the terminal pressing anvil portion 47 of the shield anvil 34 is tightly inserted into the terminal pressing anvil insertion portion 49 of the shield crimper 37. Then the pressing piece 18 of the shield pressing portion 16 is swaged. Thereby, the shield 62 is attached to the shield pressing portion 16.

Further, the terminal pressing anvil portion 50 of the external covering anvil 35 is tightly inserted into the terminal pressing anvil insertion portion 52. Then the hold pressing piece 19 of the external covering pressing portion 17 is swaged. Thereby, the external covering 63 is attached to the external covering pressing portion 17. Furthermore, the pressing terminal 2 is separated from the carrier 11A upon being attached as described above.

After the wiring process described above is completed, the crimper unit 32 left the pressing terminal placing portion 53 and the pressing terminal 2 is conveyed.

Figure 3:
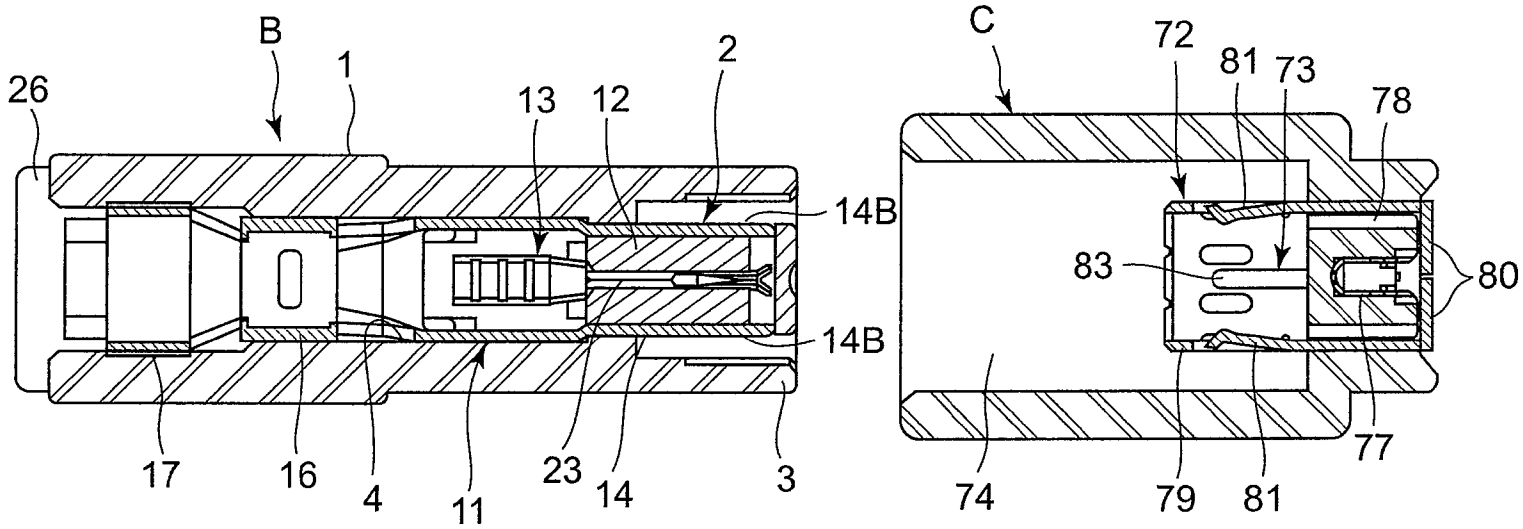
FIG. 3 is a sectional view showing the electrical connector according to the embodiment of the invention, wherein the connector plug and the connector socket are not connected to each other.
Figure 4:
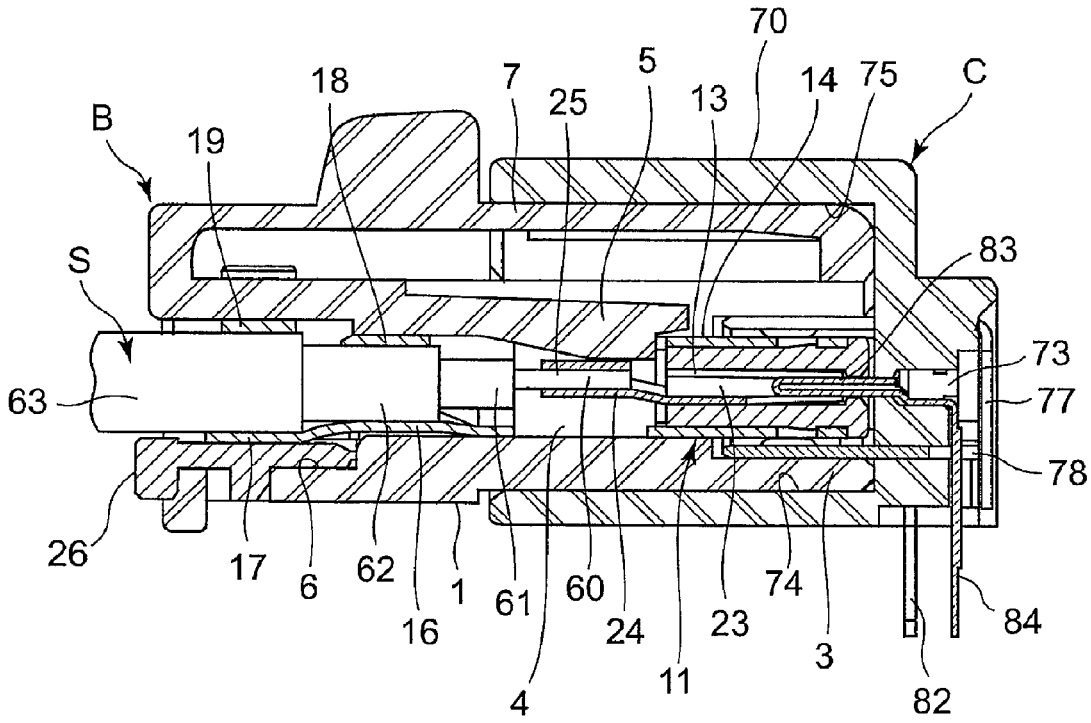
FIG. 4 is a sectional view showing the electrical connector according to the embodiment of the invention, wherein the connector plug and the connector socket are connected to each.

As shown in FIGS. 3 and 4, the pressing terminal 2 is inserted in the pressing terminal insertion portion 4 of the plug insulating housing 1. Further, the lance portion 5 engages an end portion of the shield outer tube 14 of the pressing terminal 2. Furthermore, a retainer 26 is inserted in the retainer insertion portion 6. Thereby, the pressing terminal 2 is fixed in the plug insulating housing 1 and thus the connector plug B is configured.

Figure 12:
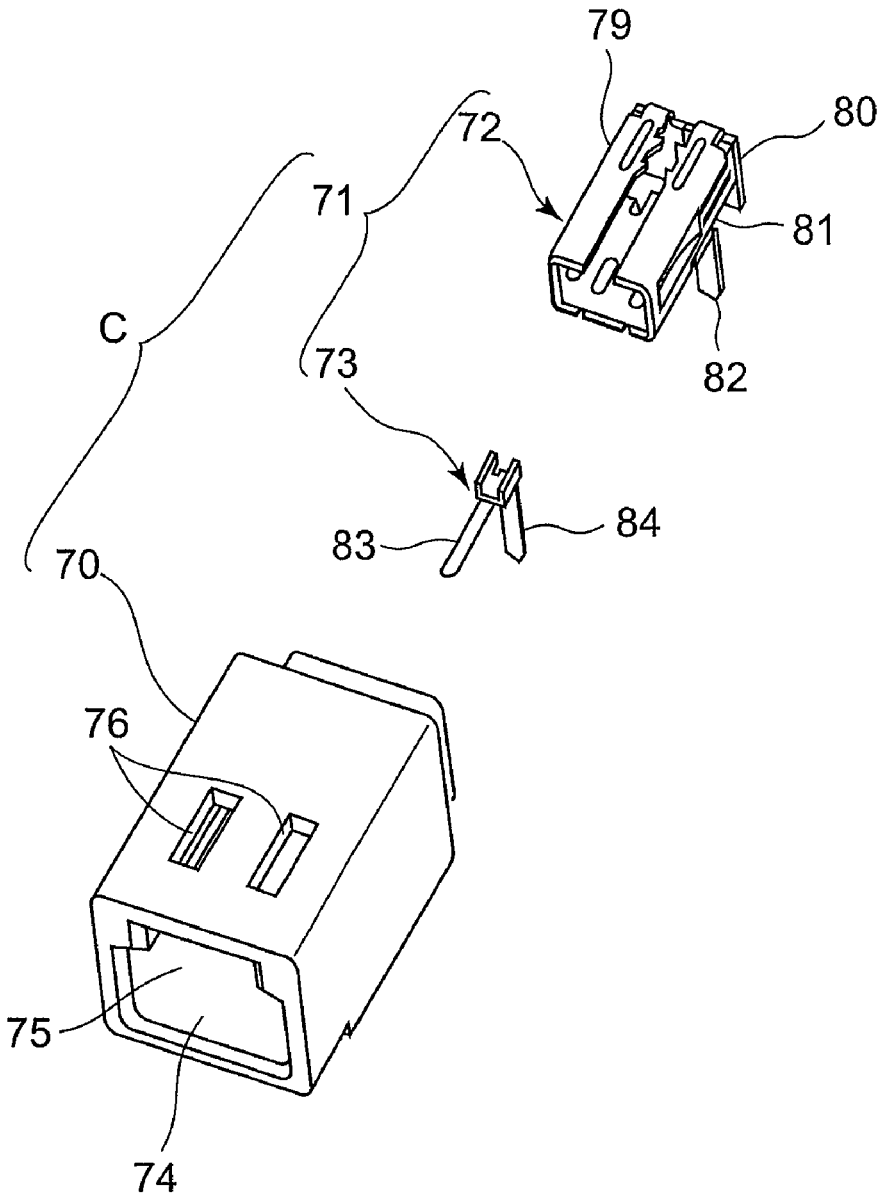
FIG. 12 is a perspective view showing the connector socket in a disassembled state according to the embodiment of the invention.

As shown in FIG. 12, the connector socket C as a mating connector includes a socket insulating housing 70 and a mating terminal 71. The mating terminal 71 is composed of a mating outer conductive member 72 and a mating inner conductive member 73.

The socket insulating housing 70 includes a socket connecting portion 74. The socket connecting portion 74 has a rectangular shape as seen in a longitudinal direction thereof and has an implementation surface in a bottom surface thereof. The socket connecting portion 74 further includes a lock lever insertion portion 75 formed from a front end portion to a rear portion of an upper portion thereof. As shown in FIG. 12, an engaging hole 76 is provided on an upper surface of the lock lever insertion portion 75. In addition, as shown in FIGS. 3 and 4, a mating inner conductive member attaching portion 77 and a mating outer conductive member attaching portion 78 are provided in an end wall portion of the socket connecting portion 74.

As shown in FIG. 12, the mating outer conductive member 72 includes a shield outer tube 79. The shield outer tube 79 is formed by bending a metal plate material. An end portion of the shield outer tube 79 is covered with an end shield portion 80. The shield outer tube 79 further includes a shield contact terminal 81, a piece having a tongue-like shape formed by cutting and raising a central portion of both side surfaces thereof. In addition, the shield outer tube 79 includes a pair of shield terminals 82 facing to each other.

As shown in FIG. 12, the mating inner conductive member 73 includes a connecting terminal 84 which is provided in a contact portion 83.

As shown in FIGS. 3 and 4, the mating inner conductive member 73 is attached to mating inner conductive member attaching portion 77 and the mating outer conductive member 72 is attached to the mating outer conductive member attaching portion 78. Accordingly, the shield outer tube 79 of the mating outer conductive member 72 is settled in the socket connecting portion 74 from a rear of the socket insulating housing 70 via the mating outer conductive member attaching portion 78.

The connector plug B is connected to the connector socket C as described below. As shown in FIG. 4, the socket connecting portion 74 of the connector socket C is connected to the plug connecting portion 3 of the connector plug B. Accordingly, contact portion 83 of the mating inner conductive member 73 contacts the contact portion 23 of the inner conductive member 13. Thereby, the inner conductive member 13 and the mating inner conductive member 73 conduct to each other. Further, the terminal contacting portion 14C on the outer surface of the shield outer tube 14 of the inner conductive member 11 contacts the shield contact terminal 81 of the mating outer conductive member 72 so that the outer conductive member 11 and the mating outer conductive member 72 conduct to each other. Furthermore, the lock lever 7 of the connector plug B is inserted into the lock lever insertion portion 75 so that the lock engaging protrusion 8 engages the engaging hole 76 to lock each other.

As described above, according to the embodiment of the present invention, the two protruding portions 21 is provided protruding and extending in parallel on the side surface of the dielectric member 12. Therefore, when the inner conductive member 13 is held in the shield outer tube 14 via the dielectric member 12, the dielectric member 12 holding the inner conductive member 13 is forcibly inserted into the shield outer tube 14 with the protruding portion 21 sliding and being ground against the terminal fitting portion 14B. As a result, it is possible to eliminate a clearance between an outer circumference surface of the dielectric member 12 and an inner circumference surface the shield outer tube 14 by balancing in a right and left direction.

Accordingly, the pressing piece 25 of the signal line pressing portion 24 can be situated in the pressing tool insertion opening portion 15 without shifting from the center of the pressing tool insertion opening portion 15. The signal line crimper 36 and the signal line anvil 33 can swage the pressing piece 25 of the signal line pressing portion 24 thus situated in the pressing tool insertion portion 15, thereby attaching the signal line 60 of the signal wire S. As described above, since it is possible to obtain the space for the wiring process precisely, it is not necessary to design the signal line anvil 33 so that the terminal pressing anvil portion 40 and the claw portion 43, which are the pressing teeth of the signal line anvil 33 and the signal line crimper 36 respectively, do not interfere with the pressing piece of the signal line pressing portion 24. Consequently, it is possible to downsize the pressing terminal 2. Eventually, it is possible to downsize the connector plug B, and the electrical connector A.

In addition, according to the embodiment of the present invention, when the signal line 60 is attached by swaging the pressing piece 25 of the signal line pressing portion 24, the terminal pressing anvil portion 40 is ushered to the terminal pressing anvil insertion portion 52, thereby stabilizing a fixing position and a fixing form. In addition, it is possible to prevent the pair of the claw portions 43 from being bent to open since the pair of the claw portions 43 of the signal line crimper 36 is inserted into the claw insertion groove portion 42. Therefore, since durability of the signal line crimper 36 can be improved, it is possible to prevent the tip portion of the signal line crimper 36 from being broken and to make the tip portion of the signal line crimper 36 finer. Consequently, it is possible to downsize the pressing terminal 2. Eventually, it is possible to downsize the connector plug B, and the electrical connector A.

When the signal line 60 is attached at the signal line pressing portion 24 in the pressing tool insertion opening portion 15, the sidewall portions 15*a* and 15*b* of the pressing tool insertion opening portion 15 can be an obstacle for providing the claw clamp portion 41. According to the embodiment of the present invention, it is possible to provide the claw clamp portion 41 since the pressure receiving surface 40A of the terminal pressing anvil portion 40 supports the signal line pressing portion 24 so that both of the sidewall portions 15*a* and 15*b* of the pressing tool insertion opening portion 15 do not contact with the top surface 41A of the claw clamp portion 41. In addition, it is possible to prevent the pair of the claw portion 43 from being bent to open since the pair of the claw portion 43 of the signal line crimper 36 is inserted into the claw insertion groove portion 42. Therefore, since durability of the signal line crimper 36 can be improved, it is possible to prevent a tip portion of the signal line crimper 36 from being broken and to make the tip portion of the signal line crimper 36 finer. Consequently, it is possible to downsize the pressing terminal 2. Eventually, it is possible to downsize the connector plug B, and the electrical connector A.

According to the embodiment of the present invention, the signal line crimper 36 includes the thicker portion 45 in the portion thereof except the forefront side portion of the substantially central portion of the pair of the claw portions 43. Therefore, durability of the signal line crimper 36 can be improved. Consequently, it is possible to prevent a tip portion of the signal line crimper 36 from being broken and to make the tip portion of the signal line crimper 36 finer. Therefore, it is possible to downsize the pressing terminal 2. Eventually, it is possible to downsize the connector plug B, and the electrical connector A.

In the embodiment of the present invention described above, in the wiring process, the anvil unit 31 is situated in a specific position and the crimper unit 32 is moved toward the pressing terminal 2. Instead, in the wiring process, the anvil unit 31 and the crimper unit 32 may be moved toward the pressing terminal 2.

Industrial Applicability

The pressing terminal according to the present invention, when an inner conductive member is held in a shield outer tube via a dielectric member, the dielectric member holding the inner conductive member is forcibly inserted into the shield outer tube with a protruding portion thereof sliding and being ground against an inner surface of the shield outer tube. Accordingly, it is possible to eliminate a clearance between an outer circumference surface of the dielectric member and an inner circumference surface the shield outer tube by balancing in a right and left direction. As a result, a pressing piece of a signal line pressing portion of the inner conductive member can be situated in a pressing tool insertion opening portion without shifting from a center of the pressing tool insertion opening portion. Therefore, it is possible to obtain a precise space for a wiring process. Consequently, it is not necessary to design pressing tools (a signal line anvil and a signal line crimper) so that pressing teeth thereof do not interfere with the pressing piece, in order to obtain the space for the wiring process. Accordingly, it is possible to downsize the pressing terminal. Eventually, it is possible to downsize a connector including such that pressing terminal (for example, a connector plug), and an electrical connector as a whole. The pressing terminal described above can be useful as a terminal of a coaxial cable and the like for an input and output portion equipped on an information terminal device, an electric device of a car, and the like.

The disclosure of Japanese Patent Applications No. 2009-144548, filed on Jun. 17, 2009 is incorporated in the application by reference.

While the invention has been explained with reference to the specific embodiments of the invention, the explanation is illustrative and the invention is limited only by the appended claims.

What is claimed is:

1. A pressing terminal to be connected to a mating terminal of a mating connector, comprising:

an outer conductive member to be connected to a mating outer conductive member of the mating terminal, said outer conductive member including a shield outer tube having an opening, a pressing tool insertion opening portion, and a shield wire pressing portion for pressing a shield wire;

an inner conductive member to be connected to a mating inner conductive member of the mating terminal, said inner conductive member including a signal line pressing portion for pressing a signal line of the shield wire; and a dielectric member for holding the inner conductive member, wherein said dielectric member includes a main body portion retained in the shield outer tube and a cap portion having a size greater than that of the opening so that the cap portion is situated outside the opening, said dielectric member further includes a protruding portion formed on the main body, and said protruding portion extends from near the cap portion up to a middle of the main body so that the main body is easily fitted into the shield outer tube.

2. The pressing terminal according to claim 1, wherein said protruding portion includes a plurality of protruding bands extending in a connecting direction of the pressing terminal, said protruding bands being situated on opposite surfaces of the dielectric member.

3. The pressing terminal according to claim 1, wherein said shield outer tube includes an engaging hole, and said main body includes an engaging protrusion for engaging with the engaging hole.

* * * * *